United States Patent [19]

Rosen et al.

[11] Patent Number: 4,802,914

[45] Date of Patent: Feb. 7, 1989

[54] PROCESS FOR AGGLOMERATING MINERAL ORE CONCENTRATE UTILIZING DISPERSIONS OF POLYMER BINDERS OR DRY POLYMER BINDERS

[75] Inventors: Meyer R. Rosen, Parsippany; Lawrence Marlin, Bridgewater; Anthony C. Bracco, Howell, all of N.J.

[73] Assignee: Union Carbide Corporation, Danbury, Conn.

[21] Appl. No.: 903,968

[22] Filed: Sep. 5, 1986

Related U.S. Application Data

[63] Continuation-in-part of Ser. No. 736,237, May 21, 1985.

[51] Int. Cl.[4] ..... C22B 1/08

[52] U.S. Cl. ..... 75/3; 75/4; 75/5

[58] Field of Search ..... 75/3–5

[56] References Cited

U.S. PATENT DOCUMENTS

| | | | |
|---|---|---|---|
| 3,307,927 | 3/1967 | Müschenborn | 75/3 |
| 3,418,237 | 12/1968 | Booth | 75/3 |
| 3,585,025 | 6/1971 | Obst | 75/3 |
| 3,644,113 | 2/1972 | Lang | 75/3 |
| 3,765,869 | 10/1973 | Schierloh | 75/3 |
| 3,823,009 | 7/1974 | Lailach | 75/3 |
| 3,860,414 | 1/1975 | Lang | 75/3 |
| 3,893,847 | 7/1975 | Derrick | 75/3 |
| 3,898,076 | 8/1975 | Ranke | 75/3 |
| 4,004,918 | 1/1977 | Fukuoka | 75/11 |
| 4,199,348 | 4/1980 | Ground | 75/3 |
| 4,452,940 | 6/1984 | Chu et al. | 524/801 |
| 4,597,797 | 7/1987 | Roorda et al. | 106/194 |

FOREIGN PATENT DOCUMENTS

| | | | |
|---|---|---|---|
| 0533975 | 12/1956 | Canada . | |
| 0890342 | 1/1972 | Canada | 53/13 |
| 265133 | 6/1970 | U.S.S.R. . | |
| 277808 | 8/1970 | U.S.S.R. . | |
| 901313 | 1/1982 | U.S.S.R. . | |
| 954464 | 8/1982 | U.S.S.R. . | |
| 996485 | 1/1983 | U.S.S.R. . | |
| 1063850 | 12/1983 | U.S.S.R. . | |

OTHER PUBLICATIONS

Kramer, 29th An. Min. Symp., (1968), 145:51.

Armstrong, Aus. I.M.M. Conf., (1973), 543:6.

Dokuchayev et al., "Utilization of Surface-Active Agents Pelletization of Iron Ore Concentrates", *Metallurgy and Mining Institute, Bulletin of Scientific and Technical Information, Production of Sbornik*, No. 3, pp. 5–8, (1972).

Bershnov et al., Pelletizing Fire-Grained Iron Ore Concentrates, Moscow, Nedra Publishers, 1971.

Poszhidayeva et al., "Selection of a Binder Additive for the Manufacture of Pellets", *IZVESTIYA VUZ-ov. Ferrous Metallurgy*, No. 2, pp. 13–15, (1984).

*Primary Examiner*—Peter D. Rosenberg

*Attorney, Agent, or Firm*—Henry H. Gibson

[57] ABSTRACT

This invention is a method for agglomerating mineral ore concentrate comprising the commongling of mineral ore concentrate with a binding amount of a water soluble, high molecular weight polymer. The selected polymer is applied to the mineral ore concentrate either (1) as a dispersion in a non-aqueous medium or (2) as a dry powder. The most preferred polymers are water soluble poly(acrylamide) based polymers.

63 Claims, No Drawings

PROCESS FOR AGGLOMERATING MINERAL ORE CONCENTRATE UTILIZING DISPERSIONS OF POLYMER BINDERS OR DRY POLYMER BINDERS

This application is a continuation-in part of U.S. application Ser. No. 736,237, filed May 21, 1985, and is related to commonly assigned U.S. application Ser. No. 773,700, filed Sept. 9, 1985, now abandoned and refiled as U.S. application Ser. No. 875,250, June 17, 1986.

BACKGROUND OF THE INVENTION 1. Field of the Invention

This invention relates generally to methods for agglomerating or pelletizing mineral ore concentrate. More specifically, this invention relates to methods for agglomerating or pelletizing mineral ore concentrate using water soluble, high molecular weight polymer binder systems in water in-oil emulsions, in oil dispersions or as a dry powder. 2. Description of the Prior Art It is customary in the mining industry to agglomerate or pelletize finely ground mineral ore concentrate so as to further facilitate the handling and shipping of the ore.

Mineral ore concentrates can include iron oxides, copper oxides, barytes, lead and zinc sulfides, and nickel sulfides. Agglomerates of coal dust and nonmetalic minerals used to make bricks or ceramics are also formed. Agglomerate forms can include pellets, briquettes, and sinters.

Methods of pelletizing mineral ore concentrate are frequently used in mining operations where the ore is a low grade iron ore. Examples of low grade iron ores are taconite, hematite, and magnetite. Numerous other low grade ores exist wherein pelletizing of the ground particles is beneficial to the handling and shipment of the mineral ore. After the mineral ore has been mined, it is frequently ground and screened to remove large particles which are recycled for further grinding. Typically, an ore is passed through a 100 mesh (0.149 mm) screen. The screened mineral ore is known as a "concentrate".

For example, taconite mineral ore concentrate after grinding and screening has an average moisture content of between about 6 to about 10 percent. The moisture content of the mineral ore concentrate can be selectively altered. The moisture content affects the strength of the pellets that are formed later in the process.

After screening, the mineral ore concentrate is transported on a first conveyor means to a balling drum, balling disc, or another means for pelletizing mineral ore concentrate. Prior to entering the balling apparatus, a binding agent is applied or mixed into the mineral ore concentrate. Commingling the binding agent with the mineral ore concentrate occurs both on the conveyor means and in the means for pelletizing. The binding agents hold the mineral ore concentrate together as pellets until after firing.

Balling drums are apparatus comprising long cylindrical drums which are inclined and rotated. The mineral ore concentrate is simultaneously rotated about the balling drum's circumference and rolled in a downward direction through the drum. In this manner the mineral ore concentrate is rolled and tumbled together to form roughly spherical shaped pellets. As the pellets grow in size and weight they travel down the incline of the drum and pass through the exit of the drum at which point they are dropped onto a second conveyor means which transports them to a kiln for firing. Inside the balling drum, different factors influence the mechanisms of union of the mineral ore concentrate. These factors include the moisture content of the ore, the shape and size of the mineral ore particles, and the distribution of concentrate particles by size. Other properties of the mineral ore concentrate that influence the pelletizing operation include the mineral ore's wettability and chemical characteristics. The characteristics of the equipment used, such as its size and speed of rotation, can affect the efficiency of the pelletizing operation. The nature and quantity of the agglomerating or binding agent used in the concentrate is also a factor that determines part of the efficiency of the pelletizing operation.

The formation of agglomerates begins with the interfacial forces which have a cohesive effect between particles of mineral ore concentrate. These include capillary forces developed in liquid ridges between the particle surfaces. Numerous particles adhere to one another and form small pellets. The continued rolling of the small pellets within the balling apparatus causes more particles to come into contact with one another and adhere to each other by the capillary tension and compressive stress. These forces cause the union of particles in small pellets to grow in much the same manner as a snowball grows as it is rolled.

After the balling operation, the pellets are formed, but they are still wet. These pellets are commonly known as "green pellets", though taconite pellets, for example, are usually black in color. Green pellets usually have a density of about 130 lb/ft$^3$ in sizes between about $\frac{1}{2}$ inch and about $\frac{3}{8}$ of an inch in diameter. The green pellets are transported to a kiln and heated in stages to an end temperature of approximately 2800° F. After heating, fired pellets are extremely hard and resist cracking upon being dropped and resist crushing when compressed.

Two standard tests are used to measure the strength of pellets whether the pellets are green pellets or fired pellets. These tests are the "drop" test and the "compression" test. The drop test requires dropping a random sampling of pellets a distance, usually about 18 inches or less onto a steel plate. Said pellets are dropped a number of times until the pellets crack. The number of drops to crack each pellet is recorded and averaged. Compression strength is measured by compressing or applying pressure to a random sampling of pellets until the pellets crumble. The pounds of force required to crush the pellets is recorded and averaged. These two tests are used to measure the strength of both wet and fired pellets. The drop and compressive test measurements are important because pellets, proceeding through the balling drum and subsequent conveyor belts, experience frequent drops as well as compressive forces from the weight of other pellets travelling on top of them.

Thermal shock resistance is a factor which must be taken into consideration in any process for agglomerating mineral ore concentrate. Increases in a pellet's thermal shock resistance improve that pellet's ability to resist internal pressures created by the sudden evaporation of water when the pellet is heated in a kiln. If the pellet has numerous pores through which the water vapor can escape thermal shock resistance is improved. If the surface of the pellet is smooth and continuous without pores the pellet has an increased tendency to shatter upon rapid heating. This causes a concurrent increase in the amount of "fines" or coarse particles in the pelletized mineral ore. A binder which increases the pores formed in a pellet improves that pellet's ability to resist thermal shock.

Bentonite is used as a binding agent in the pelletizing operations for taconite ore concentrate. Bentonite produces a high strength pellet having an acceptable drop strength, compressive strength, and thermal shock resistance. Bentonite has the disadvantage of increasing the silica content of the pellets that are formed. Silica decreases the efficiency of blast furnace operations used in smelting of the ore. For this reason bentonite requires a higher energy expenditure than do organic binders.

Binding agents other than bentonite have proven to be useful as binders. These agents include organic binders such as poly(acrylamide), polymethacrylamide, carboxymethylcellulose, hydroxyethylcellulose, carboxyhydroxyethylcellulose, poly(ethylene oxide), guar gum, and others. The use of organic binders in mineral ore pelletizing operations is desirable over the use of bentonite because organic binders do not increase the silica content of pellets and they improve the thermal shock resistance of the pellets. Organic binders burn out during pellet firing operations and cause an increase in the porosity of the pellets. Firing conditions can be modified to improve fired pellets' mechanical properties for organic binder systems.

Some organic binders used in mineral ore pelletizing operations are dissolved in an aqueous solution which is sprayed onto the mineral ore concentrate prior to entering the balling. This application of an aqueous solution increases the moisture content above the natural or inherent moisture content of the mineral ore concentrate, which requires a greater energy expenditure during the firing operation of the pellets. This increased moisture content also causes an increased likelihood of shattering due to inadequate thermal shock resistance during firing. Pellet formation is improved with the use of organic binders, but the drop strength and compression strength of the pellet are frequently below that desired or achieved with bentonite.

Other binders commonly used for agglomerating mineral ore concentrate include a mixture of bentonite, clay and a soap, Portland cement, sodium silicate, and a mixture of an alkali salt of carboxymethylcellulose and an alkali metal salt. The agglomerates made from these binding agents frequently encounter the problems described above of insufficient pellet strength or insufficient porosity for the rapid release of steam during induration with heat. Additionally, these binding agents are usually applied to a mineral ore concentrate in aqueous carrier solutions or as dry powders. Aqueous carrier solutions increase the amount of energy required to fire the pellets and increase the incidence of pellet shattering due to inadequate thermal shock resistance.

U.S. Pat. No. 3,893,847 to Derrick discloses a binder and method for agglomerating mineral ore concentrate. The binder used is a high molecular weight, substantially straight chain water soluble polymer. This polymer is used in an aqueous solution. The polymers disclosed as useful with the Derrick invention include copolymers of acrylamide as well as other polymers. The Derrick invention claims the use of polymers in an "aqueous" solution. The use of water as a carrier solution for the binding agents increases the moisture of the agglomerates or pellets that are formed. The higher moisture content increases the energy required to fire the pellets and can increase the rate of destruction of the pellets during induration due to the rapid release of steam through the agglomerate.

The industry is lacking a method for agglomerating mineral ore concentrate utilizing low water content non-bentonite binder systems, such as water soluble, high molecular weight polymer binder systems in water-in-oil emulsions, dispersions in oil, or dry powders. This invention provides pellets formed from the mineral ore concentrate of high mechanical strength properties.

SUMMARY OF THE INVENTION

This invention is a method for agglomerating a particulate material such as a mineral ore concentrate comprising the commingling of mineral ore concentrate with a binding amount of water soluble, high molecular weight polymers. The polymers are adapted to be selectively usable in at least one of either of two conditions of use. In a first condition of use the polymers are applied to the mineral ore concentrate as a dry powder. In a second condition of use the polymers are applied to the mineral ore concentrate as a dispersion in a non-aqueous dispersion medium, that is for example in one or more of the following forms: (i) a water in oil emulsion in which oil is the non aqueous portion of the emulsion, or (ii) a dispersion of fine polymer particles in oil such as may be made by removing water from a water in oil emulsion or by methods described in U.S. Pat. No. 4,325,861 of Braun and Rosen. "Oil" is used broadly in this context to include any vehicle, preferably an organic vehicle, which is a non solvent for the polymer. The size of the fine polymer particles is preferably such that, in the selected dispersion medium, they either resist settling and stratification, or if they have a tendency to settle or stratify, they are easily redispersed before addition to the mineral ore concentrate. The size of the dispersed fine polymer particles required for such stability will therefore depend on the characteristics of the selected dispersion medium, particularly its density and viscosity.

This invention also includes as one embodiment a method comprising the commingling of dry poly(acrylamide) based polymer onto mineral ore concentrate wherein the inherent or added moisture content of the mineral ore concentrate is sufficient to activate the poly(acrylamide) based polymer to form pellets of the mineral ore.

This invention is particularly desirable when used with an iron ore concentrate and can also include the application of an inorganic salt such as sodium carbonate, calcium carbonate, dolomite, magnesium carbonate, sodium chloride, sodium metaphosphate and mixtures of these in conjunction with the polymer. The inorganic salt can be applied as a powder or an aqueous solution.

DETAILED DESCRIPTION OF THE INVENTION

This invention is a method for agglomerating particulate material such as a mineral ore concentrate using water soluble, high molecular weight polymers in an amount sufficient to bind the mineral ore concentrate. The polymers are applied to the particulate material in at least one of the following systems: a water-in-oil emulsion system, a dispersion in oil system, another non-aqueous dispersion medium system, or a dry powder system. The application of the polymers to a mineral ore concentrate can be in conjunction with an inorganic salt or mixtures of inorganic salts applied as powders or in aqueous solutions. The polymers and inorganic salts are commingled with the mineral ore concentrate. This composition then enters a standard means for pelletizing such as a balling disc or drum. The means for pelletizing further commingles the ingredients and forms wet or "green" pellets. The pellets are then transferred or conveyed to a furnace or kiln where they are indurated by heat at temperatures above about 1800° F. and more preferably at about 2800° F. After induration, the pellets are ready for shipping or further processing in a smelting operation such as a blast furnace.

Suitable polymers useful in this invention include water soluble homopolymers, copolymers, terpolymers, and tetrapolymers. In a water-in oil emulsion system and some dispersion in oil systems the selected polymer is produced by polymerizing its monomeric water-in oil emulsion precursor. Suitable polymers can be anionic, cationic, amphoteric, or nonionic. It is desirable in this invention to use polymers of high molecular weight as characterized by a high intrinsic viscosity. This invention is not limited to polymers of high intrinsic viscosity.

Polymers suitable for use with this invention, whether used in water-in-oil emulsion systems, dispersion in oil systems, or in dry powder systems, are particularly desirable when they are of a high molecular weight. The particular molecular weight of a polymer is not limiting upon this invention. Suitable polymers include synthetic vinyl polymers and other polymers as distinguished from derivatives of natural celulosic products such as carboxymethycellulose, hydroxyethylcellulose, and other cellulose derivatives.

Useful measurements of a polymer's average molecular weight are determined by either the polymer's intrinsic viscosity or reduced viscosity. In general, polymers of high intrinsic viscosity or high reduced viscosity have a high molecular weight. An intrinsic viscosity is a more accurate determination of a polymer's average molecular weight than is a reduced viscosity measurement. A polymer's ability to form pellets of mineral ore concentrate is increased as the polymer's intrinsic viscosity or reduced viscosity is increased. The most desirable polymers used in the process of this invention have an intrinsic viscosity of from about 0.5 to about 40, preferably from about 2 to about 35 and most preferably from about 4 to about 30 dl/g as measured in a one normal (N) aqueous sodium chloride solution at 25° C.

Water soluble polymers include, among others, poly(acrylamide) based polymers and those polymers which polymerize upon addition of vinyl or acrylic monomers in solution with a free radical. Typically, such polymers have ionic functional groups such as carboxyl, sulfamide, or quaternary ammonium groups. Suitable polymers can be derived from ethylenically unsaturated monomers including acrylamide, acrylic acid, and methylacrylamide. Alkali metal or ammonium salts of these polymers can also be useful.

Desirable polymers for use in this invention are preferably of the following general formula:

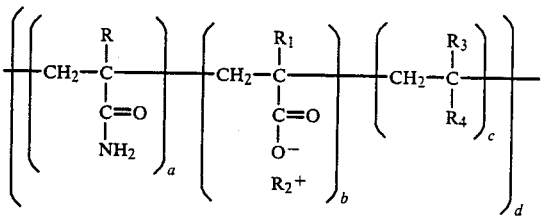

wherein R, $R_1$ and $R_3$ are independently hydrogen or methyl, $R_2+$ is an alkali metal ion, such as $Na+$, $K+$ or equivalent cation such as $NH_4+$, $R_4$ is either (1) $—OR_5$ wherein $R_5$ is an alkyl group having up to 5 carbon atoms;

(2)

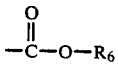

wherein $R_6$ is an alkyl group having up to 8 carbon atoms;

(3)

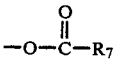

wherein $R_7$ is either methyl, or ethyl;

(4) phenyl;

(5) substituted phenyl;

(6) —CN; or (7)

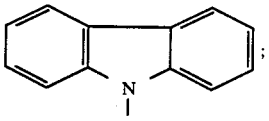

and wherein (a) is from 0 to about 90, preferably from about 30 to about 60 percent, (b) is from 0 to about 90, preferably from about 30 to about 60 percent, (c) is from about 0 to about 20 with the proviso that (a)+(b)+(c) equal 100 percent, and (d) is an integer of from about 1,000 to about 500,000.

Under certain conditions, the alkoxy or acryloxy groups in the polymer can be partially hydrolyzed to the corresponding alcohol group and yield a tetrapolymer of the following general formula:

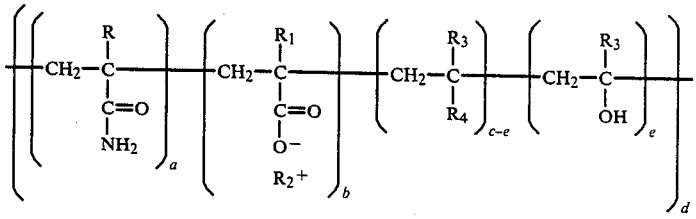

wherein R, $R_1$, $R_2+$, $R_3$, a, b, and d are as previously defined, $R_4$ is $$-OR_5 \text{ or } O-\overset{O}{\overset{\|}{C}}-R_7$$

wherein $R_5$ and $R_7$ are as defined previously, c is from about 0.2 to about 20 percent, and e is from about 0.1 to less than about 20 percent.

The preferred copolymers are of the following formula:

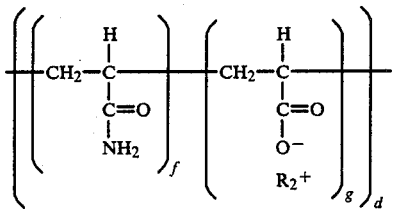

wherein $R_2^+$ is an alkali metal ion, such as $Na^+$, $K^+$ or equivalent cation such as $NH_4^+$, and f is from 5 to about 90, preferably from about 30 to about 60 percent, g is from 5 to about 90, preferably from about 30 to about 60 percent with the proviso that (f)+(g) equal 100 percent, and (d) is an integer of from about 1,000 to about 500,000.

The preferred terpolymers are of the following formula:

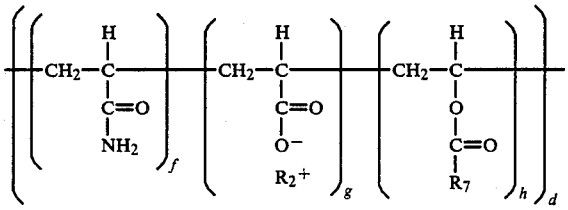

wherein $R+_2^+$ is $Na^+$, $K^+$, or an equivalent cation such as $NH_4^+$, $R_7$ is methyl, ethyl, or butyl and f is from about 5 to about 90, preferably from about 30 to about 60 percent, g is from about 5 to 90, preferably from about 30 to 60 percent, h is from about 0.2 to about 20, with the proviso that (f)+(g)+(h) equal 100 percent and d is as previously defined. The preferred tetrapolymers are of the following formula:

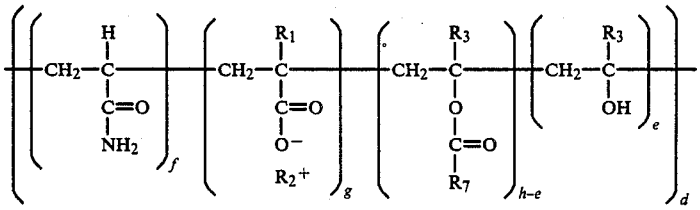

wherein $R_1$, $R_2^+$, $R_3$, $R_7$, f, g, h, d, and e are as previously defined.

Other desirable water soluble polymers for use with this invention include those derived from homopolymerization and interpolymerization of one or more of the following water soluble monomers: acrylic and methacrylic acid; acrylic and methacrylic acid salts of the formula $$CH_2{=}\overset{R_8}{\overset{|}{C}}-\overset{O}{\overset{\|}{C}}-O-R_9$$

wherein $R_8$ is a hydrogen atom or a methyl group and $R_9$ is a hydrogen atom, an alkali metal atom (e.g., sodium, potassium), an ammonium group, an organoammonium group of the formula $(R_{10})(R_{11})(R_{12})$ NH+ (where $R_{10}$, $R_{11}$ and $R_{12}$ are independently selected from a hydrogen atom, and an alkyl group having from 1 to 18 carbon atoms (it may be necessary to control the number and length of long-chain alkyl groups to assure that the monomer is water soluble), such as 1 to 3 carbon atoms, an aryl group, such as benzyl group, or a hydroxyalkyl group having from 1 to 3 carbon atoms, such as triethanolamine, or mixtures thereof; acrylamide and methacrylamide and derivatives including acrylamido- and methacrylamido monomers of the formula:

$$CH_2{=}\overset{R_{13}}{\overset{|}{C}}-\overset{O}{\overset{\|}{C}}-N\begin{matrix}R_{14}\\R_{15}\end{matrix}$$

wherein $R_{13}$ is a hydrogen atom or a methyl group; wherein $R_{14}$ is a hydrogen atom, a methyl group or an ethyl group; wherein $R_{15}$ is a hydrogen atom, a methyl group, an ethyl group or $-R_{16}-SO_3X$, wherein $R_{16}$ is a divalent hydrocarbon group alkylene, phenylene, or cycloalkylene having from 1 to 13 carbon atoms, preferably an alkylene group having from 2 to 8 carbon atoms, a cycloalkylene group having from 6 to 8 carbon atoms, or phenylene, most preferably

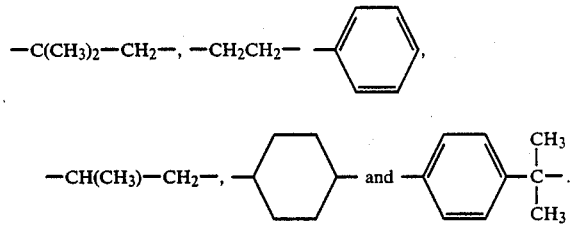

X is a monovalent cation such as a hydrogen atom, an alkali metal atom e.g., sodium or potassium), an ammonium group, an organoammonium group of the formula $(R_{17})(R_{18})(R_{19})$ NH+ wherein $R_{17}$, $R_{18}$, $R_{19}$ are independently selected from a hydrogen atom, an alkyl group having from 1 to 18 carbon atoms (it may be necessary to control the number and length of long-chain alkyl groups to assure that the monomer is water soluble) such as 1 to 3 carbon atoms, an aryl group such as a phenyl or benzyl group, or a hydroxyalkyl group having from 1 to 3 carbon atoms such as triethanolamine, or mixtures thereof, and the like. Specific examples of water-soluble monomers which can be homopolymerized or interpolymerized and useful in the process of this invention are acrylamido and methacrylamido- sulfonic acids and sulfonates such as 2-acrylamido 2-methylpropanesulfonic acid (available from the Lubrizol Corporation under its tradename, and hereinafter referred to as, AMPS), sodium AMPS, ammonium AMPS, organoammoium AMPS. These polymers can be effective binding agents for mineral ore concentrates in about the same concentrations or binding amounts used for other polyacrylamide based polymer binders.

These water soluble monomers can be interpolymerized with a minor amount (i.e., less than about 20 mole percent, preferably less than about 10 mole percent, based on the total monomers fed to the reaction) of one or more hydrophobic vinyl monomers. For example, vinyl monomers of the formula

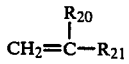

wherein $R_{20}$ is a hydrogen atom or a methyl group and $R_{21}$ is

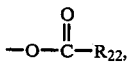

a halogen atom (e.g., chlorine),

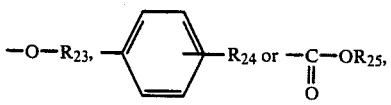

wherein $R_{25}$ is an alkyl group, an aryl group or an aralkyl group having from 1 to 18 carbon atoms, wherein $R_{22}$ is an alkyl group having from 1 to 8 carbon atoms, $R_{23}$ is an alkyl group having from 1 to 6 carbon atoms, preferably 2–4 carbon atoms, $R_{24}$ is a hydrogen atom, a methyl group, an ethyl group, or a halogen atom e.g., chlorine), preferably a hydrogen atom or a methyl group, with the proviso that $R_{20}$ is preferably a hydrogen atom when $R_{22}$ is an alkyl group. Specific examples of suitable copolymerizable hydrophobic vinyl monomers are alkyl esters of acrylic and methacrylic acids such as methyl acrylate, methyl methacrylate, ethyl acrylate, ethyl methacrylate, butyl acrylate, isobutyl acrylate, dodecyl acrylate, 2-ethylhexyl acrylate, etc.; vinyl esters such as vinyl acetate, vinyl proprionate, vinyl butyrate, etc.; vinylbenzenes such as styrene, alpha-methyl styrene, vinyl toluene; vinyl ethers such as propyl vinyl ether, butyl vinyl ether, isobutyl vinyl ether, methyl vinyl ether, ethyl vinyl ether, etc.; vinyl halides such as vinyl chloride, vinylidene chloride, etc.; and the like.

The preferred water soluble monomers of these water soluble polymers are acrylamide, AMPS and sodium AMPS, sodium acrylate, and ammonium acrylate. The preferred hydrophobic monomers are vinyl acetate, ethyl acrylate, styrene and methyl methacrylate.

Examples of suitable polymers for use with this invention in water-in-oil emulsions are listed in Table I. This table provides a representative listing of suitable polymers for use in the water-in-oil emulsions, but does not encompass every suitable polymer or limit the polymers that can be used with this invention.

TABLE I

| Poly(acrylamide) Emulsions[1] | | | |
|---|---|---|---|
| Anionic Copolymers | Mole % PAM/Na Acrylate | Intrinsic Viscosity | % Solids |
| | 85/15 | 16.2 | 30 |
| | 76/24 | 17.3 | 30 |
| | 59/41 | 20.0 | 30 |
| Cationic Copolymers | PAM/Sipomer Q5-80[2] | | |
| | 94/16 | | |
| Nonionic Copolymers | PAM/N—decyl Acrylamide | | |
| | 99/1 | 5.8 | 30 |
| Anionic Terpolymers | PAM/NaA Vinyl Acetate | | |
| | 54.2/41.1/4.6 | 10.8 | 30 |
| | | 23.0 | 29.5 |
| | 71/24/5 | 20.0 | 30 |
| | 80/15/5 | RV[3] = 17.5 | 30 |
| | PAM/NaAMPS/Vinyl Acetate | | |
| | 87/12/1 | 10.0 | |

[1]Abbreviations: PAM: poly(acrylamide); NaA: sodium acrylate; NaAMPS: sodium salt of 2-acrylamido-2-methyl-propanesulfonic acid.
[2]Sipomer Q5-80 is a cationic compound of dimethylaminoethylmethacrylate/-dimethyl sulfate quaternary salt.
[3]Reduced viscosity.

A second class of polymers includes those polymers used with this invention in dry powder form. These polymers must be water soluble, but do not necessarily lend themselves to the formation of water-in-oil emulsions. Typically, polymers which form water-in-oil emulsions are also useful with the invented method as dry powder. Table II represents a listing of polymers which are desirable for use with this invention as powders. The powders listed in Table II do not encompass all polymers which can be used as powders in this invention.

TABLE II

| Poly(acrylamide) Powders | | |
|---|---|---|
| Nonionic | Rhone Poulenc AD-10[1] (intrinsic viscosity 15.4 dl/g) | |
| Anionic | | Approximate mole % PAM/NaA |
| | Percol ® 725[2] | 89/11 |
| | Percol ® 726 | 77/23 |

[1]AD-10 is a poly(acrylamide) powder sold by Rhone Poulenc, 52 Vanderbilt Avenue, New York, NY.
[2]Percol ® products have been analyzed to be copolymers containing the approximate mole % of PAM and NaA given in Table II and are sold by Allied Colloids of Fairfield, New Jersey.

A third class of polymers includes those polymers used with this invention in the form of dispersions in oil. A representative but non-limiting list of polymers useful in this form includes those set forth in Table I.

Inorganic salts are optionally added to the mineral ore concentrate before balling operations primarily to increase the strength of wet pellets (green drop strength) or dry pellets (dry crush strength). Inorganic salts can be added either before, after, or during the addition of the dry or emulsified polymer. Polymers alone improve the dry compression strength of pellets, but not to the same degree as an inorganic salt. For this reason, desirable embodiments of this invention include the addition of an inorganic salt, however, this addition is not considered limiting upon this invention. Similarly, neither the inorganic salt selected nor the method of addition is limiting upon this invention. For purposes of this invention the term "polymer binder system" can include a water soluble, high molecular weight polymer in a water-in-oil emulsion system, a polymer dispersed in oil or other non-aqueous medium, or a powder system regardless of whether the system includes, or is used with or without inorganic salt powders or solutions.

Inorganic salts suitable for use in this invention include alkali and alkali metal salts of carbonates, halides, or phosphates. Specific examples of inorganic salts include sodium carbonate ($Na_2CO_3$), calcium carbonate ($CaCO_3$, which may also be referred to in this specification as limestone), dolomite, magnesium carbonate, sodium metaphosphate $(NaPO_3)_n$ where n is 2 or more, sodium chloride (NaCl), and mixtures of these. Other inorganic salts can be added to improve pellet strength. Additionally, inorganic salts can be added in mixtures concentration of inorganic salt increases in the mineral ore concentrate, the strength of the resulting pellets is increased.

Water soluble, inorganic salts, such as sodium carbonate, can be used for improving the compression strength of pellets. These salts can be used alone, in combination with other soluble inorganic salts, or in combination with water insoluble inorganic salts and are most effective, when used with either the dry, emulsified or other dispersed polymer, in an amount of at least 2 percent and preferably greater than 25 percent, calculated on the total weight of added water soluble inorganic salt plus active polymer. Preferably the concentration of water soluble inorganic salts as a percent of the weight of the polymer binder system varies from about 25 percent to about 95 percent. More preferably, water soluble inorganic salts are within the range of about 30 percent to about 90 percent with the most optimum range between about 50 percent to about 90 percent calculated on the total weight of the mixture of added water soluble inorganic salts plus active polymer.

The invertible water-in-oil emulsion system used in this invention is a suspension of droplets comprised of both water soluble, high molecular weight polymers and water in a hydrophobic medium. Examples of suitable emulsion systems and methods to form suitable emulsions are found in U.S. Pat. Nos. 4,485,209 to Fan et al. and 4,452,940 to Rosen et al. each of which are herein incorporated by reference.

Desirable hydrophobic liquids used in these emulsion systems are isoparaffinic hydrocarbons. A suitable isoparaffinic hydrocarbon is that sold by the Exxon Corporation known as Isopar® M. Other suitable hydrophobic liquids for use as the external phase in an emulsion system include benzene, xylene, toluene, mineral oils, kerosenes, petroleum, paraffinic hydrocarbons, and mixtures of these.

In desirable embodiments of this invention, which include a polymer binding agent in a water-in-oil emulsion, two surfactants are used to form the emulsion. A first surfactant is used to form the water-in-oil emulsion system. After the water-in-oil emulsion system is formed, a second surfactant is added. The second surfactant is a water soluble inverting surfactant which, we believe, permits the inversion of the water-in-oil emulsion to an oil-in-water emulsion upon contact with the inherent or added moisture present in the mineral ore concentrate. Upon inversion of the water-in-oil emulsion the polymer is forced out of the internal aqueous phase and made available to the surface of the mineral ore concentrate. This release of the polymer onto the surface of the mineral ore concentrate allows for rapid commingling of the polymer with the mineral ore concentrate. Emulsions that do not contain inverting surfactants, or mixtures of emulsions which do and emulsions which do not contain inverting surfactants, can be used with this invention.

The surfactants suitable for use in forming emulsions of one embodiment of this invention are usually oil-soluble having a Hydrophile-Lipophile Balance (HLB) value of from about 1 to about 10 and preferably from about 2 to about 6. These surfactants are normally referred to as water-in-oil type surfactants. Suitable surfactants include the acid esters such as sorbitan monolaurate, sorbitan monostearate, sorbitan monooleate, sorbitan trioleate, mono and diglycerides, such as mono and diglycerides obtained from the glycerolysis of edible fats, polyoxyethylenated fatty acid esters, such as polyoxyethylenated (4) sorbitan monosterate, polyoxyethylenated linear alcohol, such as Tergitol 15-S-3 and Tergitol 25-L-3 supplied by the Union Carbide Corporation, polyoxyethylene sorbitol esters, such as polyoxyethylene sorbital beeswax derivative, polyoxyethylenated alcohols such as polyoxyethylenated (2) cetyl ether, and the like.

Water-soluble inverting surfactants which can be used include polyoxyethylene alkyl phenol, polyoxyethylene (10 mole) cetyl ether, polyoxyethylene alkylaryl ether, quaternary ammonium derivatives, potassium oleate, N-cetyl N-ethyl morpholinium ethosulfate, sodium lauryl sulfate, condensation products of higher fatty alcohols with ethylene oxide, such as the reaction product of oleyl alcohol with 10 ethylene oxide units; condensation products of alkylphenols and ethylene oxide, such as the reaction products of isooctylphenol with 12 ethylene oxide units; condensation products of higher fatty acid amines with five, or more, ethylene oxide units; ethylene oxide condensation products of polyhydric alcohol partial higher fatty esters, and their inner anhydrides (mannitol-anhydride, called Mannitan, and sorbitol-anhydride, called Sorbitan). The preferred surfactants are ethoxylated nonyl phenols, ethoxylated nonyl phenol formaldehyde resins, and the like.

The inverting surfactant is used in amounts of from about 0.1 to about 20, preferably from about 1 to about 10 parts per one hundred parts of the polymer.

The mixture of both the aqueous phase and the oil phase of the emulsions used in this invention can contain about 20 to about 50 and preferably from about 22 to about 42 percent weight of the hydrophobic liquid and the hydrophobic monomers, based upon the total weight of the composition.

The aqueous solution used to from the emulsion systems of this invention can contain a mixture of water soluble monomers. These monomers have a water solubility of at least 5 weight percent and include acrylamide, methacrylamide, acrylic acid, methacrylic acid, and their alkali metal salts, aminoalkyl acrylate, aminoalkyl methacrylate, dialkylaminoalkyl acrylate, dialkylamino methacrylate and their quaternized salts wit dimethyl sulfate or methyl chloride, vinyl benzyl dimethyl ammonium chloride, alkali metal and ammonium salts of 2-sulfoethylacrylate, alkali metal and ammonium salts of vinyl benzyl sulfonates, maleic anhydride, 2-acrylamide-2-methylpropanesulfonic acid, and the like. The preferred monomers are acrylamide, acrylic acid, and sodium salt of 2-acrylamido-methylpropanesulfonic acid.

If acrylic acid is used as a monomer it is reacted with a base, preferably with an equivalent amount of base, such as sodium hydroxide, so that the sodium acrylate solution has a pH of from about 5.0 to about 10.0, preferably from about 6.5 to about 8.5, depending on the type and amount of base employed. This solution is combined with another water soluble monomer, such as acrylamide, and then with water to form the aqueous phase.

Hydrophobic monomers which can be useful in forming the emulsion systems of this invention include one or more of vinyl esters such as vinyl acetate, alkyl acrylates such as ethylacrylate, alkyl methacrylates such as methacrylate, vinyl ethers such as butylvinyl ether, acrylonitrile, styrene and its derivatives such as alpha methylstryene, N-vinyl carbazole, and the like.

Appropriate reactors and catalysts are also used with this invention. These compounds can vary. Examples of suitable reactors and catalysts can be found in the Fan and Rosen patents identified above.

Emulsions used in this invention are made by any suitable method. A desirable method for making emulsions is disclosed in U.S. Pat. No. 4,485,209 to Fan. This invention is not limited to a particular emulsion or method for producing an emulsion.

The polymer dispersed in oil systems used in this invention may be a dispersion of fine particles of polymer in oil such as may be made by removing water from water-in-oil emulsions of the kind described above. Dispersions of polymers in oil used in this invention may also be dispersions of fine particles of polymers prepared as described for example in U.S. Pat. No. 4,325,861 of Braun and Rosen. Desirable hydrophobic liquids used in these dispersions are the same as the hydrophobic liquids used in water-in-oil emulsions referred to above.

An advantage to the use of water in oil emulsions, or other dispersions in a non-aqueous dispersion medium, in the formation of pellets is that the amount of water added to the mineral ore concentrate is greatly reduced from that required to deliver polymers in aqueous solutions, thus resulting in an energy savings upon firing of the pellets. Also, the hydrophobic liquid or oil in the inverted water-in-oil emulsion system or other non-aqueous dispersion is consumed during the firing operation. The burn out of the oil droplets from the interior of the pellets increases th porosity of the pellets in much the same manner as does the burning of the organic binder or polymer from the interior of the pellets. This increase in porosity is believed to improve the release of water vapor from the pellets and decrease the occurrence of thermal shock upon firing of the pellets.

An additional benefit realized by the use of a water-in-oil emulsion system, or other dispersion in a non-aqueous dispersion medium, to deliver a polymer binder to mineral ore concentrate in pelletizing operations is a decrease in the amount of contact time required for sufficient commingling of the polymer binder with the mineral ore concentrate. The contact time of a polymer after the emulsion or other dispersion is sprayed onto the mineral ore concentrate need only be sufficient to allow activation of the polymer on the surface of the mineral ore concentrate. The amount of time can vary depending upon the emulsion or dispersion system used and the concentration of the polymer binder within the system as well as the total amount of polymer binder sprayed upon the mineral ore concentrate. In desirable embodiments of this invention, sufficient time for commingling of the polymer binder system into the mineral ore concentrate occur by spraying the water-in-oil emulsion onto the mineral ore concentrate upstream of where the concentrate enters the balling apparatus.

Application of water in oil emulsion, or other dispersion in a non-aqueous dispersion medium, at the mineral ore concentrate treatment site can be accomplished by applying the emulsion or other dispersion to the mineral ore concentrate through any conventional spraying or dripping apparatus. The inorganic salts are sprinkled from a vibrating hopper or other dispersing means onto the mineral ore concentrate and the composition is conveyed towards the balling apparatus. Alternatively, salt can be delivered from aqueous solutions of about 5 to about 40 percent solid material depending on the solubility of the inorganic salt and the temperature. The activation of the polymers onto the surface of the mineral ore concentrate is rapid, and because the polymers are evenly spread or commingled throughout the mineral ore concentrate, the time required for sufficient commingling to initiate pellet formation is usually about one minute or less.

This invention also includes the application of binding polymer systems to mineral ore concentrate that are dry powders. In these embodiments the dry powdered polymers are mixed together optionally with the dry inorganic salt. The resulting powder composition is sprinkled onto the mineral ore concentrate as the concentrate is conveyed towards the balling apparatus. The vibration of the conveyor means and the action of the balling drum commingles the powders into the mineral ore concentrate. Upon sufficient contact time with the moisture in the mineral ore concentrate, the polymers are adsorbed onto the surface of the concentrate. Suitable contact time can be essentially instantaneous, but often is between about 1 minute to 3 hours or more. Further commingling occurs in the mixing within the balling drum. The use of the dry powder polymer embodiments of this invention eliminates the need for spraying equipment. This invention also includes the application of powdered binders to a mineral ore concentrate in conjunction with an application of inorganic salt as an aqueous solution.

While the process of this invention comprises using polymer dispersions or dry powders alone, it also comprises their use with other materials such as bentonite. In a preferred method of practicing the present invention, the water in oil emulsion contains approximately 30 weight percent of a copolymer (prepared from approximately 50 weight percent acrylamide monomer and 50 weight percent sodium acrylate monomer), 35 weight percent water, 35 weight percent Isopar® M, and a nonyl phenol ethoxylate as a surfactant. Before spraying onto taconite concentrate, the emulsion may be filtered to remove gels which might clog the spray nozzle. The emulsion is added at the rate of about 0.6 pounds per tonne. In accordance with the invention of Ser. No. 773,700, filed Sept. 9, 1985, and assigned to a common assignee, bentonite may also be added at the rate of 9 pounds per tonne. Preferably, the bentonite is added after the emulsion and just before the taconite concentrate enters the pelletizing drums or discs. The process of this invention may also be used to make flux pellets. These pellets are made by adding to the taconite concentrate an inorganic material that tends to reduce the acidity of the resulting pellets. The inorganic material may be one or more of the following: dolomite ($(Ca,Mg)CO_3$), high calcium dolomite (also known as limestone or calcium carbonate) and magnesium carbonate. These may be added prior to, simultaneously with, or after the addition of the polymer to the particulate material. Flux pellets are sometimes described in terms of their basicity the ratio of bases to acids defined as the ratio of weight % $(CaO+MgO)/(SiO_2+Al_2O_3)$. When basicity is measured, flux pellets may typically have a basicity ratio of about 1.0 to 1.1.

The useful range of the concentration of the polymer on an active basis is between about 0.001 percent to about 0.3 percent based on weight of bone dry concentrate. The preferred range is between about 0.001 percent and about 0.1 percent. These ranges are applicable for both dry and dispersed form applications of polymer binders. Should the use of a water soluble inorganic salt be desired, the useful concentration range, based upon the weight of bone dry concentrate, is between about 0.001 percent and about 0.5 percent with the preferred range being between about 0.005 percent and about 0.3 percent. This range is useful for flux or non-flux pellets.

The invention is further understood from the Examples below, but is not to be limited to the Examples. The numbered Examples represent the present invention. The lettered Examples do not represent this invention and are for comparision purposes. Temperatures given are in °C. unless otherwise stated. The following designations used in the Examples and elsewhere herein have the following meanings:

| ABBREVIATION | DEFINITION |
|---|---|
| AM | acrylamide |
| Apx. | approximate |
| $CaCO_3$ | calcium carbonate |
| $(Ca,Mg)CO_3$ | dolomite |
| cc | cubic centimeter |
| CMC | carboxymethylcellulose |
| $CO_2$ | carbon dioxide |
| dl/g | deciliter per gram |
| °F. | degrees Fahrenheit |
| gm/cc | grams per cubic centimeter |
| gms | grams |
| HEC | hydroxyethylcellulose |
| IV | intrinsic viscosity |
| lb | pound or pounds |
| mm | millimeters |
| NaA | sodium acrylate |
| NaAMPS | sodium salt of 2-acrylamido-2-methylpropanesulfonic acid |
| NaCl | sodium chloride |
| $(NaPO_3)_n$ | sodium metaphosphate where n is 2 or more |
| $Na_2CO_3$ | sodium carbonate |
| $Na_2O$ | sodium oxide |
| PAM | poly(acrylamide) |
| psi | pounds per square inch pressure |
| RPM | revolutions per minute |
| RV | reduced viscosity |
| tonne | metric ton |
| U.S. | United States |
| VA | vinyl acetate |
| wt | weight |
| wt % | weight percent |
| % | percent by weight unless otherwise specified |

LABORATORY EXPERIMENTAL PROCEDURE

In these Examples taconite pelletizing consists of a two step procedure. Initially, seed balls are prepared from the taconite ore using bentonite clay as a binder. These seed balls are passed through screens to obtain seed balls of a size that pass through a 4 U.S. mesh screen having a 0.187 inch opening, but not through a 6 U.S. mesh screen having a 0.132 inch opening. The seed balls are then used with additional concentrate and the binder of interest to prepare the larger green pellets. Finished green pellets are sieved to be in a size range between 13.2 mm to 12.5 mm. This can be accomplished by using U.S.A. Sieve Series ASTM-E-11-70. Following sieving, the green pellets are tested for wet crushing strength and wet dropping strength. Additional green pellets are dried (not fired) and tested for both dry crushing and dry dropping strength. For the examples cited, all testing was done with either wet or dry green pellets.

Seed ball formation in these examples is begun with a sample of 900 grams (bone dry weight) of taconite concentrate containing between 8 to 10% moisture. The concentrate is sieved through a 9, 10, or 12 mesh screen and spread evenly over an oil cloth. Next 7.0 grams of bentonite clay is spread evenly over the top of the concentrate and mixed until homogenous. The mixture is incrementally added to a rotating rubber drum having approximately a 16 inch diameter and a 6 inch cross section. The drum is rotated at 64 RPM. Humidity is not controlled in these Examples. Just prior to addition of concentrate, the inside of the drum is wet with water from a spray bottle. While rolling, several handfuls of the bentonite-concentrate mixture is added to the drum. Distilled water is added when the forming agglomerates begin to develop a dull appearance. As seed pellets are formed, they are screened to separate and obtain pellets which pass through a 4 mesh screen, but not through a 6 mesh screen. Captured fines are readded to the balling drum and oversized seeds are rejected. The procedure of readding captured fines is repeated several times until sufficient seed pellets of the desired size have been produced. The seed pellets are then rolled for one minute to finish the surface. Formed seed pellets can be placed in a sealed container containing a damp cloth so as to retard dehydration of the pellets.

Green pellet formation in these Examples is begun with a sample of 1800 grams (bone dry weight) of mineral ore containing between 8 to 10% moisture. The concentrate is added into a 12 inch diameter Cincinnati Muller and mixed for 1.0 minute. Thereafter, an amount of binder to be used in the Example is uniformly distributed over the surface of the concentrate. In Examples using emulsion polymers, the polyers are uniformly delivered dropwise from a syringe. When an inorganic salt, such as $Na_2CO_3$, is used in an Example, it is sprinkled over the surface of the concentrate. For those examples which employ a $Na_2CO_3$ solution, a 30 percent salt solution is used. For those examples which employ powdered polymers, the powder is dry blended with the inorganic salt and the resulting mixture is then uniformly sprinkled over the concentrate in the muller. The muller is then turned on for three minutes to mix the binder with the concentrate. The uniform mixture is then screened through an 8 mesh screen.

After moistening the inside of the rotating balling drum or tire, about 40 grams of seed pellets are added to the tire. Then the concentrate and binder mixture is incrementally fed into the drum over a period of six minutes with intermittent use of distilled water spray. During the initial portion of this process, small amounts of the concentrate and binder mixture are added each time the surface of the pellets appear shiny. Typically, the latter portion of the six minute rotating period requires an increased amount of the concentrate and binder mixture when compared to the initial part of the rotating period. Water spray is applied each time the surface of the pellets takes on a dull appearance. After the six minute rotating period is complete, the balling drum is rotated one additional minute to "finish off" the pellet surface. No water spray is used during the final one minute period. Following completion of this procedure, the green pellets are screened for testing purposes to a size between 13.2 mm and 12.5 mm.

Compression testing in these Examples is performed by using a Chatillon Spring Tester of a 25 pound range (Model LTCM—Ser. No. 567). Twenty green pellets are crushed in the tester within 30 minutes of pellet completion at a loading rate of 0.1 inches per second. The pounds of force required to crush each pellet is averaged for the twenty pellets and is herein called the wet crush strength. An additional twenty pellets are dried for one hour at 350° F. While these pellets are still warm to the touch, the crushing procedure is repeated to obtain the dry crush strength average measured in pounds per square inch (psi).

Drop testing in these Examples is performed with twenty green pellets which are tested within 30 minutes of their formation. These pellets are dropped one at a time from a height of 18 inches onto a steel plate. The number of drops to obtain pellet failure is recorded. Pellet failure is determined when a crack in a pellet of approximately a 0.7 mm or greater occurs. The average for twenty wet pellet drops is reported. Twenty additional green pellets are dried by the procedure set out for the compression test and then each is dropped from a 3 inch height. The average number of drops to obtain pellet failure for twenty pellets is determined and recorded.

Definition of acceptable or target pellet mechanical properties is defined in these Examples, within limits of experimental error, by a comparison to the performance of Peridur, a commercial binder. Peridur was analyzed to be 68 percent carboxymethylcellulose with about 16 percent NaCl and about 16 percent $Na_2CO_3$. Peridur is known to produce acceptable results in some plant scale pelletizing operations at a dose of 1.55 lb product/tonne of concentrate. Since the product is about 68% sodium carboxymethylcellulose, Peridur is used at an active polymer dose of about 1.05 lb/tonne. Peridur is sold by Dreeland Colloids, 1670 Broadway, Denver, Colo.

Wet drop numbers above about 2.5 and wet crush numbers above about 3.0 are useful. Dry drop numbers greater than about 2.0 and dry crush numbers above about 4 are acceptable. Comparisons of pellet mechanical properties for different binders need to be made at approximately equal pellet moisture contents. Wet pellet properties are important because wet pellets are transported by conveyors and are dropped from one conveyor to another during their movement. Dry properties are important because in kiln operations pellets can be stacked from 6 to 7 inches high to several feet. The pellets at the bottom of such a pile must be strong enough so as not to be crushed by the weight of the pellets on top of them. Dry pellets are also conveyed and must resist breakage upon dropping.

Unless otherwise stated in the following examples, the term, water-in-oil emulsion, refers to a water-in-oil emulsion containing an inverting surfactant. In these emulsions the oil phase is Isopar® M.

EXAMPLE A

The experimental procedure described above was used to prepare and test two samples of green pellets of taconite concentrate formed with a commercial CMC/NaCl/$Na_2CO_3$ binding agent system. The amount of binding agent used and the results are presented in Table III.

TABLE III

| lb Peridur per tonne | lb active polymer/ tonne | wet crush | wet drop | dry crush | wet drop | % $H_2O$ |
|---|---|---|---|---|---|---|
| 1.18 | 0.80+ | 4.6 | 2.7 | 4.2 | 2.1 | — |
| | | 4.6 | 2.5 | 4.8 | 2.1 | 9.2 |

+carboxymethylcellulose

EXAMPLE I

The experimental procedure described above was used to prepare and test two samples of green pellets of taconite concentrate formed with a PAM/NaA/VA binding agent in a water-in-oil emulsion. The mole percent of PAM/NaA/VA is 54.2/41.1/4.6. The oil used in the external phase was Isopar® M. The intrinsic viscosity of the polymer was 23 dl/g. The amount of binding agent used and the results are presented in Table IV.

TABLE IV

| lb emulsion per tonne | lb active polymer/ tonne | wet crush | wet drop | dry crush | dry drop | % $H_2O$ |
|---|---|---|---|---|---|---|
| 1.36* | 0.40 | 4.0 | 4.5 | 4.9 | 2.7 | 9.1 |
| 0.91* | 0.27 | 3.5 | 3.0 | 3.6 | 2.4 | 9.1 |

*also contains 0.78 lb $Na_2CO_3$/tonne

This example shows that the dual addition of an emulsion containing the polymer derived from acrylamide, sodium acrylate, and vinyl acetate in 54.2/41.1/4.6 mole percent along with $Na_2CO_3$ produce a taconite binder which is superior to the binder system used in Example A which employs a CMC/NaCl/$Na_2CO_3$ binding agent. At one half the active polymer dose the PAM/NaA/VA $Na_2CO_3$ system gave a higher wet drop number than the control binder of Example A.

EXAMPLE B

The experimental procedures described in Examples A and I were used to prepare and test the green pellets of taconite concentrate in this Example. The pellets of this Example are formed with either a commercial CMC/NaCl/$Na_2CO_3$ or HEC/$Na_2CO_3$ binder system. The concentration and test results are in Table V below.

TABLE V

| binder | lb active polymer/ tonne | wet crush | wet drop | dry crush | dry drop | % $H_2O$ |
|---|---|---|---|---|---|---|
| HEC/$Na_2CO_3$+ | 0.78 | 3.3 | 3.0 | 4.0 | 2.5 | — |
| CMC/NaCl/ $Na_2CO_3$++ | 1.05 | 4.0 | 2.9 | 5.4 | 2.8 | 8.0 |

+50/50 mixture, i.e., 0.78 lb of $Na_2CO_3$ per tonne.
++68/16/16 wt % (average of 3 runs)

EXAMPLE II

The experimental procedures described in Examples A and I were used to prepare and test green pellets of taconite concentrate fomed with a PAM/NaA/VA binding agent in a water-in-oil emulsion. The mole percent of PAM/NaA/VA is 54.2/41.1/4.6. The oil used in the external phase was Isopar ® M. The concentration and test results are in Table VI below.

TABLE VI

| | lb active polymer/ tonne | wet crush | wet drop | dry crush | dry drop | % $H_2O$ |
|---|---|---|---|---|---|---|
| PAM/NaA/VA—$Na_2CO_3$* | 0.78 | 3.3 | 6.2 | 6.8 | 4.3 | 9.8 |

*This is a 50/50 mixture, i.e., 0.78 lb of $Na_2CO_3$ per tonne; PAM/NaA/VA had an IV of 10.3 dl/g.

This Example shows that the dual addition of a 54.2/41.1/4.6 mole percent PAM/NaA/VA binding system with a lower molecular weight as evidenced by an IV of 10.3 in a water-in-oil emulsion along with $Na_2CO_3$ produces a taconite binder system which is superior to the current art employing combinations of hydroxyethylcellulose/$Na_2CO_3$ or carboxymethylcellulose/NaCl/$Na_2CO_3$. Note that wet drop number, dry crush and dry drop were all better with the PAM/NaA/VA-$Na_2CO_3$ binder system.

EXAMPLES C AND III

The procedures for preparing and testing the green pellets in these Examples were the same as described for Examples A and I. These Examples compare pellet strength resulting from varying concentrations of polymer binder systems. The concentrations and test results are in Table VII below.

TABLE VII

| Example | | Total Dose lb/ tonne | Active polymer Dose lb/ tonne | wet crush | wet drop | dry crush | dry drop | % $H_2O$ |
|---|---|---|---|---|---|---|---|---|
| III | PAM/NaA/VA* $Na_2CO_3$ | 1.55 | 0.78 | 3.2 | 11.6 | 5.6 | 4.1 | 10.0 |
| C | CMC/NaCl $Na_2CO_3$ | 1.55 | 1.05 | 3.4 | 2.7 | 5.3 | 2.0 | 8.8 |
| III | PAM/NaA/VA* $Na_2CO_3$ | 1.17 | 0.39 | 3.6 | 3.4 | 4.2 | 2.2 | 8.7 |
| C | CMC/NaCl $Na_2CO_3$ | 1.17 | 0.80 | 4.2 | 2.6 | 4.4 | 2.1 | 8.2 |
| III | PAM/NaA/VA* $Na_2CO_3$ | 1.00 | 0.22 | 3.5 | 3.0 | 3.4 | 2.5 | 8.9 |
| C | CMC/NaCl $Na_2CO_3$ | 1.00 | 0.68 | 3.9 | 2.5 | 2.9 | 2.1 | 8.5 |

+lb active polymer plus lb $Na_2CO_3$.
*intrinsic viscosity 23, mole percent of 54.2/41.1/4.6.

These examples show that mechanical properties of taconite pellets formed with a PAM/NaA/VA binding agent in a water-in-oil emulsion improve with increasing dose. Comparison of the poly(acrylamide) based polymer binder system in Example III is made at each concentration to a CMC/NaCl/$Na_2CO_3$ binder system in Example C.

EXAMPLE IV

The procedures for preparing and testing the green pellets in this Example were the same as described for Example I. This Example compares the effect of intrinsic viscosity on pellet strength for a poly(acrylamide) based polymer binder system. The intrinsic viscosities and test results are in Table VIII below.

TABLE VIII

| DOSE: 0.78 LB ACTIVE POLYMER/TONNE* | | | | | |
|---|---|---|---|---|---|
| IV | wet crush | wet drop | dry crush | dry drop | % $H_2O$ |
| 10.8 | 2.8 | 8.1 | 5.4 | 4.3 | 10.3 |
| 23.0 | 3.2 | 11.6 | 5.6 | 4.1 | 10.1 |

*Mole percent of PAM/NaV/VA 54.2/41.1/4.6 and also contains 0.78 pounds $Na_2CO_3$ per tonne.

This example shows that polymer binder systems of higher intrinsic viscosity produce better mechanical pellet properties with taconite concentrate when the polymer binder is a PAM/NaA/VA terpolymer.

EXAMPLE V

The procedures for preparing and testing the green pellets in this Example were the same as described for Example I. This Example compares the effect on pellet strength occurring when the mole ratios of a polymer's monomers are varied. The mole ratios and the test results are presented in Table IX below.

TABLE IX

| DOSE: 0.22 LB ACTIVE POLYMER/TONNE PLUS 0.78 LB $Na_2CO_3$/TONNE | | | | | |
|---|---|---|---|---|---|
| Polymer Composition Mole Percent PAM/NaA/VA | wet crush | wet drop | dry crush | dry drop | % $H_2O$ |
| 54.2/41.1/4.6[1] | 3.5 | 3.0 | 3.4 | 2.5 | 8.9 |
| 71/24/5[2] | 4.1 | 4.0 | 4.4 | 2.0 | 8.5 |
| 80/15/5[3] | 3.9 | 3.4 | 4.7 | 2.7 | 8.2 |
| PAM/NaA[4] 59/41 | 3.8 | 3.0 | 3.8 | 2.1 | 8.8 |

[1]IV 23.0 dl/g, 29.5% active polymer
[2]IV 20.0 dl/g, 30% active polymer
[3]RV 17.5 dl/g, 30% active polymer
[4]Approximately IV 20.0 dl/g, 30% active polymer This Example shows that NaA between tabout 15 and about 41.1 mole percent ws not critical to achieve satisfactory perofrmance in an acrylamide polymer.

EXAMPLES D AND VI

The procedures for preparing and testing the green pellets in this Example were the same as described for Example A and I. The concentrations and test results are in Table X below.

TABLE X

| DOSE: 0.39 LB ACTIVE PAM COPOLYMER*/TONNE PLUS 0.78 LB $Na_2CO_3$/TONNE | | | | | | |
|---|---|---|---|---|---|---|
| Example | Copolymer mole % PAM/NaA | wet crush | wet drop | dry crush | dry drop | % $H_2O$ |
| VII | 59/41[1] | 3.4 | 5.5 | 4.4 | 2.5 | 9.1 |
| VII | 76/24[2] | 3.3 | 4.2 | 4.6 | 2.8 | 8.5 |
| VII | 85/15[3] | 3.7 | 4.9 | 4.8 | 2.3 | 8.1 |
| VII | 100/0[4] powder | 3.4 | 2.5 | 4.4 | 3.3 | 8.0 |
| D | CMC Peridur Control[5] | 4.2 | 2.6 | 4.4 | 2.1 | 8.2 |

*(1.05 lb emulsion/tonne).
[1]IV = approximately 20 dl/g.
[2]IV = 17.3 dl/g.
[3]IV = 16.2 dl/g.
[4]IV = 15.4 dl/g., this powder is AD-10 sold by Rhone Poulenc.
[5]1.17 lb/tonne (containing 0.8 lb CMC polymer/tonne).

These Examples show that acrylamide copolymers containing 0 to at least 41 mole percent $Na_2CO_3$ acrylate are effective as binding agents for taconite concentrate.

EXAMPLE VII

Except for the use of polymer in powder form and sprinkling the dry powder onto the concentrate, the procedures for preparing and testing the green pellets in this Example were the same as described in Example I. The concentrations and test result are in Table XI below.

TABLE XI

| Dose: As shown + 0.78 lb $Na_2CO_3$/tonne | | | | | | |
|---|---|---|---|---|---|---|
| copolymer mole % PAM/NaA | active polymer dose lb/tonne | wet crush | wet drop | dry crush | dry drop | % $H_2O$ |
| 89/11 | 0.78 | 3.9 | 4.4 | 6.8 | 3.1 | 9.2 |
| 77/23 | 0.78 | 3.7 | 6.9 | 7.9 | 3.3 | 9.1 |

These Examples show that solid poly(acrylamide) based copolymers in powder form are effective binding agents for teconite concentrate.

EXAMPLES E AND VIII

The proceducres for preparing and testing the green pellets in these Examples were the same as described in Examples A and I. The polymer binder system used and the test results are in Table XII below.

TABLE XII

| Dose of PAM based polymers 0.39 lb active/tonne + 0.78 lb $Na_2CO_3$/tonne | | | | | |
|---|---|---|---|---|---|
| Composition | wet crush | wet drop | dry crush | dry drop | % $H_2O$ |
| PAM/N Decyl Acrylamide (99/1) nonionic | 2.7 | 3.0 | 4.7 | 3.0 | 8.5 |
| PAM/Sipomer Q5-80[1] 94/6 cationic | 3.1 | 2.4 | 4.4 | 2.8 | 8.4 |
| CMC/NaCl/ $Na_2CO_3$ (control)[2] | 4.2 | 2.6 | 4.4 | 2.1 | 8.2 |

[1]Sipomer Q5-80 is Dimethylaminoethylmethacrylate/Dimethyl sulfate quaternary salt.
[2]0.8 lb CMC/tonne.

These Examples show that emulsions of nonionic poly(acrylamide) based polymers with long chain hydrophobic groups and cationic modified PAM perform well as taconite binders when compared to CMC based products. The results obtained from these Examples demonstrate that an emulsion of PAM/NaA/VA is better than or roughly equivalent to a CMC/NaCl-/$Na_2CO_3$ binding agent in both drop tests and compression tests.

EXAMPLE IX

The procedures for preparing and testing the green pellets in this Example were the same as described in Example I with the exception that the inorganic salt used in this example is applied as a 30 percent aqueous solution. The polymer binders in this example are in a water-in-oil emulsion. These tests were conducted on taconite ore concentrate and demonstrate the effect of applying the polymer binder emulsion and inorganic salt solution in different sequences to the mineral ore concentrate. When these liquids are applied to the mineral ore concentrate separately, the first liquid is mixed with the mineral ore concentrate in a muller. The second liquid is then added and the total composition is mixed for an additional 3 minutes. The test results are presented in Table XIII below.

TABLE XIII

| Dose: 1.1 lb emulsion[1]/tonne + $Na_2CO_3$ 0.81 lb/tonne | | | | | | |
|---|---|---|---|---|---|---|
| Method of Addition | Total Minutes of Mixing | Wet Drop | Wet Crush | Dry Drop | Dry Crush | % Water |
| Emulsion[2] then $Na_2CO_3$ Solution | 6 3 | 6.7 | 3.8 | 2.3 | 5.2 | 8.9 |
| $Na_2CO_3$ Solution then Emulsion | 6 3 | 8.4 | 3.7 | 2.0 | 4.0 | 9.1 |
| Emulsion and $Na_2CO_3$ Solution Applied Together[3] | 6 | 5.2 | 3.7 | 2.2 | 4.8 | 8.5 |

[1]The emulsion contains 27.6 percent active polymer.
[2]The emulsion was PAM/NaA/VA in a mole percent of 54.2/41.1/4.6
[3]The emulsion and inorganic salt solution were applied concurrently to the taconite ore concentrate from separate containers.

This example denonstrates that an inorganic salt solution can be applied in conjunction with polymer binders to effectively agglomerate a mineral ore concentrate.

EXAMPLE X

This Example was conducted on taconite concentrate in the same manner as Example I. This example compares the effectiveness of a binding agent in a water-in-oil emulsion both with and without an inverting surfactant. This test involved a two-step addition. The $Na_2CO_3$ powder ws added to the taconite concentrate and mixed for three minutes. The emulsion was then added and the entire composition was mixed an additional three minutes. The test results are presented in Table XIV.

TABLE XIV

| | Wet Drop | Wet Crush | Dry Drop | Dry Crush | % Water |
|---|---|---|---|---|---|
| Emulsion* with inverting surfactant | 5.1 | 3.9 | 2.0 | 4.4 | 8.5 |
| Emulsion* without inverting | 3.7 | 3.9 | 2.0 | 3.6 | 8.3 |

TABLE XIV-continued

| | Wet Drop | Wet Crush | Dry Drop | Dry Crush | % Water |
|---|---|---|---|---|---|
| surfactant | | | | | |

*Both emulsions contain PAM/NaA/VA in a 54.2/41.1/4.6 mole ratio at 1.1 pounds of emulsion (27.6 percent active polymer) per tonne and 0.81 pounds $Na_2CO_3$ per tonne.

In Example XI an anionic water-in-oil emulsion (27.6 percent solids) of PAM/NA/VA in a mole percent of 54.2/41.1/4.6 was used as a polymer binding agent. The quantities of binding agents used and the results obtained by the poly(acrylamide) based polymer binding agents are detailed in Table XV. Comparative results for other binding agents are in Table XVI.

TABLE XV

| Example | Test[1] Number | PAM/NaA/VA gal/min | PAM/NaA/VA lb/tonne | $Na_2CO_3$ lb/min | $Na_2CO_3$ lb/tonne | Wet Compression lb | Wet 18" drop | Dry[2] Compression lb | Avg. Fired[3] Compression lb | % of Fines That Break Under 200 lb | % FeO | % $H_2O$ |
|---|---|---|---|---|---|---|---|---|---|---|---|---|
| IX | 1 | 0.145 | 1.45 | 0.73 | 0.80 | — | — | — | 320 | 19 | 0.43 | 9.6 |
| IX | 2 | 0 | 0 | 0.73 | 0.80 | — | — | — | — | — | — | 9.2 |
| IX | 3 | 0.145 | 1.45 | 0.00 | 0.00 | — | — | — | — | — | — | 10.1 |
| IX | 4 | 0.10 | 0.94 | 0.73 | 0.80 | 1.5 | 8.4 | 2.3 | 194 | 63 | 0.35 | 10.1 |
| IX | 5 | 0.11 | 1.05 | 0.37 | 0.40 | 1.6 | 7.0 | 1.8 | 244 | 50 | 0.31 | 9.4 |
| IX | 6 | 0.14 | 1.34 | 0.95 | 1.04 | 2.1 | 10.6 | 2.8 | 118 | 85 | 5.1 | — |
| IX | 7 | 0.12 | 1.12 | 1.70 | 1.85 | 2.1 | 9.6 | 3.1 | 259 | 42 | 0.31 | 9.8 |

| Example | Test[1] Number | 18" Drop Min. after start of binder addition 10 | 20 | 30 | | SIZE DISTRIBUTION OF PELLETS +½" | +7/16" | +⅜" | +11/32" | +¼" | −¼" |
|---|---|---|---|---|---|---|---|---|---|---|---|
| IX | 1 | — | 16.0 | 7.3 | 7.6+ | 2.2 | 43.2 | 43.7 | 7.8 | 1.4 | 1.8 |
| IX | 2 | 6.0 | 4.2 | 3.6 | — | 13.6 | 57.1 | 19.9 | 4.8 | 2.1 | 2.5 |
| IX | 3 | 4.5 | 11.1 | 9.3 | — | 2.9 | 33.5 | 40.8 | 14.3 | 4.8 | 3.7 |
| | | | | | | 4.7 | 31.8 | 46.4 | 8.5 | 2.8 | 5.9 |
| IX | 4 | 8.7 | 7.8 | 8.5 | — | 2.7 | 27.9 | 44.6 | 15.1 | 4.6 | 5.1 |
| IX | 5 | 8.0 | 9.3 | 8.0 | — | 1.4 | 45.4 | 44.3 | 6.8 | 1.1 | 1.0 |
| IX | 6 | 10.5 | 18.7 | 13.2 | 6.6++ | 1.2 | 14.1 | 58.6 | 20.2 | 3.8 | 2.1 |
| IX | 7 | 12.5 | 12.1 | 11.9 | — | 1.9 | 22.5 | 57.9 | 12.9 | 2.8 | 1.9 |

[1]Samples were obtained by (1) filling a basket with green pellets, (2) transporting the basket through the kiln operation, and (3) testing pellets from the top, mid-top, mid-bottom, and bottom of the basket.
[2]Pellets contain no moisture, samples are taken just prior to kiln operations.
[3]Samples are taken after drying in kiln.
+48 MIN
++40 MIN

TABLE XVI

| Examples | Test number | Wet compression lb | Wet 18" drop | Dry compression lb | Average fired compression lb | % of fines that break under 200 lb | % water |
|---|---|---|---|---|---|---|---|
| F | CMC/NaCl $Na_2CO_3$ (control) 1 lb/tonne | 13(apx.) | 5.0(Apx.) | 1.0 | — | 40 | — |
| F | CMC/NaCl $Na_2CO_3$ (control) 2 lb/tonne | 1.3(Apx.) | 5.0(Apx.) | 3.5 | 251 | — | — |
| F | Bentonite* (typical values) | 2.2 to 2.7 | 7 to 10 | 5 to 6 | 440 | <6 | 9.0 |

*Apx. 18 lb/tonne.

This experiment demonstrates that acceptable green pellets are formed both with and without an inverting surfactant in the emulsion.

EXAMPLES F AND XI

The following Examples were conducted in a full scale plant with a full size balling drum and kiln. In these Examples 55 tonnes per hour of taconite concentrate were conveyed to and processed in the balling drum. The selected binding agent systems were added by spraying onto the taconite ore concentrate just prior to entering the balling drum and by vibrating the $Na_2CO_3$ powder onto the taconite ore concentrate. The average contact time of the binders with the mineral ore concentrate before entering the balling drum was approximately 0.5 to 1 minute. The average size of the green pellets obtained were between approximately one fourth to one half inch in diameter.

These Examples show that the use of polymer of this invention with no $Na_2CO_3$ produced pellets with good mechanical properties, such as high green drop, and the drop number for wet pellets and the dry compression strength of dry pellets improve with increases in $Na_2CO_3$ concentration. Varying the concentration of $Na_2CO_3$ did not show a trend in the compression strength of fired pellets.

EXAMPLE XII

Following the procedures used for preparing and testing green pellets described above in Example I, dispersions of fine particles of a polyacrylamide polymer in an oil dispersion medium were added to taconite concentrate from the Mesabi range at the rate of 0.36 pounds of dispersion product per tonne (for an effective rate of 0.18 pounds of polymer per tonne). These dispersions contained 50 weight percent light mineral oil, fifty weight percent polymer and essentially no water. In all cases, bentonite was also added at the rate of 9 pounds per tonne. The results obtained are set forth on Table XVII.

These dispersions varied in the polyelectrolyte charge density that they exhibited, as shown under the column headed "charge" in Table XVII. The non ionic polymer used in Test 1 was obtained as a homopolymer of acrylamide which applicants believe had an I.V. of about 15. The anionic polymers of Tests 2 and 3 were obtained as copolymers of acrylamide and sodium acrylate; I.V., about 15. The polymers of Tests 4 and 5 were prepared from acrylamide and quaternary salts of dimethyl aminomethyl methacrylate; I.V., about 7 to 15.

As a control, a water-in-oil emulsion which contained 30 weight percent of a copolymer prepared from acrylamide monomers and sodium acrylate monomers (approximately 50/50 weight percent) was added at the rate of 0.6 pounds per tonne (for an effective rate of 0.18 pounds of polymer per tonne) with bentonite added at the rate of 9 pounds per tonne. The results are also set forth on Table XVII.

TABLE XVII

| Test | Ionic Character | Charge | Green Drop | Green Crush | Dry Crush | % $H_2O$ in Pellets |
|---|---|---|---|---|---|---|
| 1 | Non-ionic | None | 5.2 | 4.7 | 11.4 | 9.4 |
| 2 | Anionic | Med. | 10.1 | 4.4 | 10.9 | 9.6 |
| 3 | Anionic | High | 6.5 | 4.1 | 9.9 | 9.4 |
| 4 | Cationic | Med. | 5.6 | 4.7 | 13.3 | 9.4 |
| 5 | Cationic | V. High | 5.4 | 4.9 | 11.5 | 9.5 |
| Control | Anionic | Med. | 7.0 | 4.7 | 9.6 | 9.7 |

The procedures used in preparing and testing pellets of the following Examples XIII to XVI were the same as described for Example I. The weights per tonne in these examples are based on the weight of taconite concentrate after removal of all moisture.

EXAMPLE XIII

Relatively high sodium carbonate systems, e.g. those having approximately 2.5 to 3 lb/tonne of added $Na_2CO_3$, may be used with the polymer systems of this invention to obtain improved green drop performance. In this example, polymer is used in the form of a water-in-oil emulsion containing approximately 30 weight percent of a copolymer (prepared from approximately 65 weight percent acrylamide monomer and 35 weight percent sodium acrylate monomer and having an I.V. of 10.8); approximately equal weights of water and a paraffinic/naphthalenic type hydrocarbon; and an octyl phenol ethoxylate as a surfactant. Polymer delivered as a water-in-oil emulsion and $Na_2CO_3$ delivered as a powder were added to a taconite concentrate in the amounts and with the results shown in Table XVIII.

TABLE XVIII

| lb emulsion per tonne | lb. $Na_2CO_3$ per tonne | green drop | green crush | dry crush | % $H_2O$ in pellets |
|---|---|---|---|---|---|
| 0.8 | 3.0 | 5.4 | 4.0 | 7.9 | 8.7 |

EXAMPLE XIV

In some cases it may be desirable to use reduced levels of $Na_2CO_3$ in order to reduce the sodium content of the pellets. Sodium in the pellets is believed to lead to the creation of sodium cyanides in the furnace which, in sufficiently large amounts, lead in turn to corrosion of the furnace walls. Therefore, some furnace operators would prefer to use pellets having less than about 0.075% by weight of sodium, expressed as $Na_2O$. This amount of sodium in the pellet corresponds to about 3 lb/tonne of added $Na_2CO_3$ if there is no other significant source of sodium added to or in the taconite concentrate. More preferably, one would operate at sodium levels of about 0.03% or less of sodium expressed as $Na_2O$ (i.e., at about 1.2 lb/tonne of added $Na_2CO_3$ or less). In order to eliminate added sodium we have used dolomite [$(Ca,Mg)CO_3$ or $CaCO_3$] with the polymer of Example XIII and obtained the results shown in Table XIX. This table shows that dolomite is not as effective as an equal weight of $Na_2CO_3$ with respect to green drop, a slightly higher dose of dolomite and a somewhat higher dose of polymer being required to achieve the green drop results comparable to those achieved with $Na_2CO_3$ in Example XIII.

TABLE XIX

| lb emulsion per tonne | lb dolomite per tonne | green drop | green crush | dry crush | % $H_2O$ in pellets |
|---|---|---|---|---|---|
| 0.8 | 3(1) | 4.3 | 3.6 | 3.8 | 9.2 |
| 1.0 | 6(1) | 5.3 | 3.3 | 3.2 | 9.4 |

(1)Delivered from 20% slurry in water.

EXAMPLE XV

We have found that by combining $Na_2CO_3$ at reduced levels with dolomite and the polymer of Example XIII, the levels of both green drop and dry crush are unexpectedly increased to improved levels, as shown in Table XX, while the amount of sodium is kept prefereably low. The table also illustrates that limiestone ($CaCO_3$) can be substituted for the dolomite, if desired. We believe that magnesium carbonate may also be substituted for dolomite and that a combination of these inorganic salts will be comparably useful.

TABLE XX

| lb emulsion per tonne | lb dolomite per tonne | lb limestone per tonne | lb $Na_2CO_3$ per tonne | green drop | green crush | dry crush | % $H_2O$ in pellets |
|---|---|---|---|---|---|---|---|
| 0.8 | 6.0(1) | — | 1.2(2) | 6.1 | 3.9 | 9.1 | 8.6 |
| 0.6 | 5.0(1) | — | 1.2(2) | 5.2 | 4.5 | 8.5 | 8.5 |
| 0.8 | — | 6.0(3) | 1.2(3) | 5.0 | 4.1 | 8.0 | 8.6 |

(1)Delivered from 20% slurry in water
(2)Delivered from powder.
(3)Delivered together as $Na_2CO_3$ dissolved in sufficient water to make a 35% slurry of the limestone.

EXAMPLES XVI

Table XXI shows that pellets with outstanding green properties may be obtained when using the polymer dispersion of Example XIII in flux pellets. Table XXI also illustrates that the omission of $Na_2CO_3$ affects both the green drop and dry crush of the pellets.

TABLE XXI

| lb/tonne | | | | green | green | dry | % $H_2O$ |
|---|---|---|---|---|---|---|---|
| Dolomite[1] | Limestone (1) | Emulsion | $Na_2CO_3$ | drop | crush | crush | in pellets |
| 112 | 112 | 1.0 | 3.0[2] | 9.0 | 4.3 | 9.1 | 9.2 |
| 112 | 112 | 1.0 | 1.2[2] | 5.6 | 4.2 | 9.0 | 9.0 |
| 112 | 112 | 1.0 | 3.0[3] | 6.6 | 4.3 | 7.1 | 9.2 |
| 112 | 112 | 1.0 | 0.0 | 4.7 | 3.5 | 3.4 | 9.6 |

[1]Added from a 1/1 blend as a 50% slurry in water to 60% taconite slurry (in water) prior to filtration and prior to the additional polymer and sodium carbonate.
[2]Added from a water solution downstream of the filtration of the taconite/dolomite/limestone slurry.
[3]Added from a water solution upstream of the filtration of the taconite/dolomite/limestone slurry.

We claim:

1. A process of agglomerating a particulate material consisting essentially commingling said particulate material with a binding amount of water soluble polymer, wherein said polymer is applied to said particulate material as a dispersion in a non-aqueous dispersion medium.

2. The process of claim 1 in which the polymer is contained in the aqueous portion of a water-in-oil emulsion.

3. The process of claim 1 in which fine particles of the polymer are dispersed in an essentially non-aqueous dispersion medium which is a non-solvent for the polymer.

4. The process of claim 1 wherein said polymer is a poly(acrylamide) based polymer.

5. The process of claim 4 wherein said polymer contains repeating units of the following formula:

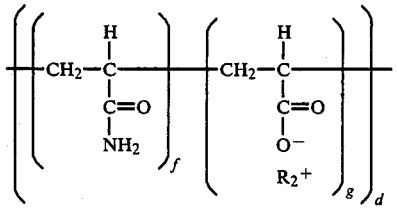

wherein $R_2+$ is an alkali metal ion, f and g are from 5 to about 90 percent, f+g=100, and d is from about 1,000 to about 500,000.

6. The process of claim 5 wherein said polymer is derived from monomer units of acrylamide and sodium acrylate.

7. The process of claim 4 wherein said polymer contains repeating units of the following formula:

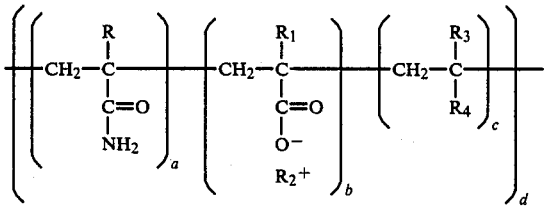

wherein R, $R_1$ and $R_3$ are independently hydrogen or methyl, $R_2+$ is an alkali metal ion and $R_4$ is either (1) $—OR_5$ wherein $R_5$ is an alkyl group having up to 5 carbon atoms;

(2)

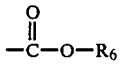

wherein $R_6$ is an alkyl group having up to up to 8 carbon atoms;

(3)

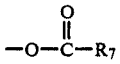

wherein $R_7$ is either metyl, or butyl;

(4) phenyl;

(5) substituted phenyl;

(6) —CN; or (7)

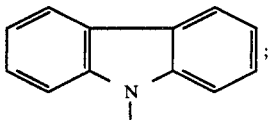

and hydrolyzed tetrapolymers thereof, wherein (a) is from about 5 to about 90 percent, (b) is from about 5 to about 90 percent, (c) is from 0 to about 20 percent, (a)+(b)+(c)=100, and (d) is from about 1,000 to about 500,000.

8. The process of claim 7 wherein said polymer is derived from monomer units of acrylamide, sodium acrylate, and vinyl acetate.

9. The process of claim 4 wherein said polymers are derived from at least one of the following groups of monomer units: acrylamide, methacrylamide and derivatives thereof of the formula:

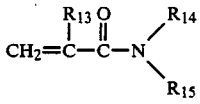

where $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation.

10. The process of claim 1 wherein said polymer is applied to said particulate material at an active polymer concentration between about 0.001 to about 0.3 percent by weight.

11. The process of claim 1, wherein an inorganic salt is commingled with said particulate material, said particulate material being mineral ore concentrate.

12. The process of claim 11 wherein said inorganic salt is an alkali metal or alkaline earth metal salt of carbonates, halides, or phosphates, or a mixture thereof, and said mineral ore concentrate is taconite concentrate.

13. The process of claim 11 wherein said inorganic salt is at least one member selected from the group consisting of sodium carbonate, calcium carbonate, dolomite, magnesium carbonate, sodium chloride, and sodium metaphosphate.

14. The process of claim 12 wherein said inorganic salt is applied to said mineral ore concentrate in an aqueous solution or slurry.

15. The process of claim 11 wherein said inorganic salt is applied to said mineral ore concentrate at a concentration between about 0.001 to about 0.5 percent by weight of concentrate.

16. The process of claim 2 wherein said water-in-oil emulsion has an oil phase selected from the group consisting of benzene, xylene, toluene, mineral oils, kerosenes, paraffinic hydrocarbons, petroleum, Isopar ® M, and mixtures thereof.

17. The process of claim 2 wherein said emulsion contains an inverting surfactant.

18. A product of the process of claim 1.

19. The process of claim 1 wherein green pellets of mineral ore are obtained by agglomerating said particulate material and said green pellets are then fired by a means for applying heat sufficient to indurate said ore.

20. The process of claim 19 wherein said sufficient heat to indurate said pellets is at least about 1800° F.

21. The process of claim 20 wherein said sufficient heat to indurate said pellets is at least about 2800° F.

22. A product of the process of claim 19.

23. A process of producing pellets consisting essentially of:

(a) selecting a water soluble polymer dispersed in a non aqueous dispersion medium;

(b) mixing a binding quantity of said polymer with a taconite concentrate;

(c) pelletizing in a balling apparatus the mixture of step (b) to form green pellets; and (d) indurating said green pellets with heat.

24. The process of claim 23 in which the polymer is contained in the aqueous portion of a water-in-oil emulsion.

25. The process of claim 23 in which fine particles of the polymer are dispersed in an essentially non-aqueous dispersion medium which is a non-solvent for the polymer.

26. The process of claim 23 wherein said polymer contains repeating units selected from the group consisting of units of the formula:

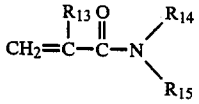

wherein $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation; units of the formula:

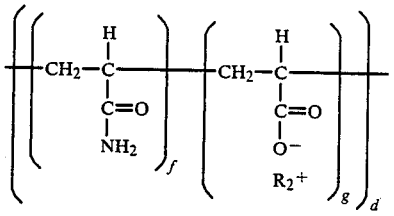

wherein $R_2+$ is an alkali metal ion, f and g are from 5 to about 90 percent, f+g=100, and d is from about 1,000 to about 500,000; and mixtures of such units.

27. The process of claim 23 wherein an inorganic salt is also mixed with the concentrate, said inorganic salt being an alkali metal or an alkaline earth metal salt of carbonates, halides, or phosphates, or a combination thereof.

28. The process of claim 27 wherein said inorganic salt is applied to said mineral ore concentrate in a concentration between about 0.001 to about 0.5 percent by weight and wherein said polymer is applied to said mineral ore concentrate at an active polymer concentration between about 0.001 to about 0.3 percent by weight.

29. A product of the process of claim 28.

30. A process of agglomerating a particulate material, comprising:

commingling said particulate material with a water soluble poly(acrylamide) based polymer, wherein said polymer is applied to said particulate material as a dry powder.

31. The process of claim 30 wherein said polymer contains repeating units of the following formula:

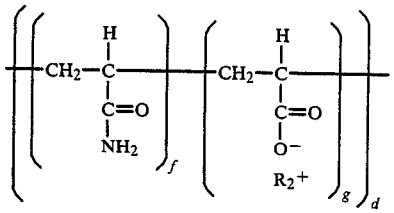

wherein $R_2+$ is an alkali metal ion, f and g are from 5 to about 90 percent, f+g=100, and d is from about 1,000 to abotu 500,000.

32. The process of claim 31 wherein said polymer is derived from monomer units of acrylamide and sodium acrylate.

33. The process of claim 30 wherein said polymer contains repeating units of the following formula:

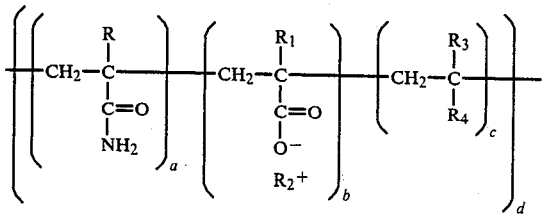

wherein R, $R_1$, and $R_3$ are independently hydrogen or methyl, $R_2+$ is an alkali metal ion, $R_4$ is either (1) $—OR_5$ wherein $R_5$ is an alkyl group having up to 5 carbon atoms;

(2)

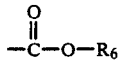

wherein $R_6$ is an alkyl group having up to up to 8 carbon atoms;

(3)

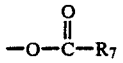

wherein $R_7$ is either methyl, or butyl;

(4) phenyl;

(5) substituted phenyl;

(6) —CN; or (7)

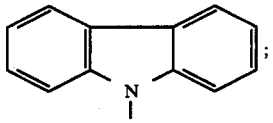

and hydrolized tetrapolymers thereof, wherein (a) is from about 5 to about 90 percent, (b) is from about 5 to about 90 percent, (c) is from 0 to about percent, (a)+(b)+(c)=100, and (d) is from about 1,000 to about 500,000.

34. The process of claim 33 wherein said polymer is derived from monomer units of acrylamide, sodium acrylate, and vinyl acetate.

35. The process of claim 30 wherein said polymers are derived from at least one of the following roups of monomer units: acrylamide, methacrylamide and derivatives thereof of the formula:

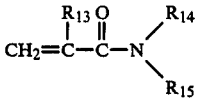

where $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation.

36. The process of claim 30 wherein said polymer is applied to said particulate material at an active polymer concentration between about 0.001 to about 0.3 percent by weight.

37. The process of claim 30 wherein an inorganic salt is commingled with said particulate material, said particulate material being a mineral ore concentrate.

38. The process of claim 37 wherein said inorganic salt is an alkali metal or alkaline earth metal salt of carbonates, halides, or phosphates, or a mixture thereof, and said mineral ore concentrate is taconite concentrate.

39. The process of claim 37 wherein said inorganic salt is at least one member selected from the group consisting of sodium carbonate, calcium carbonate, dolomite, magnesium carbonate, sodium chloride, and sodium metaphosphate.

40. The process of claim 38 wherein said inorganic salt is applied to said mineral ore concentrate in an aqueous solution or slurry.

41. The process of claim 39 wherein said inorganic salt is applied to said mineral ore concentrate at a concentration on said concentrate between about 0.001 to 0.5 percent by weight of concentrate.

42. A product of the process of claim 30.

43. The process of claim 30 wherein green pellets of mineral ore are obtained by agglomerating said particulate material and said green pellets are fired by a means for applying heat sufficient to indurate said ore, said particulate material being taconite.

44. The process of claim 43 wherein said sufficient heat to indurate said pellets is of a temperature of at least 1800° F.

45. The process of claim 44 wherein said sufficient heat to indurate said pellets is of a temperature of about 2800° F.

46. A product of the process of claim 43.

47. A process of producing pellets comprising:

(a) selecting a water soluble poly(acrylamide) based polymer, said polymer being in the form of a dry powder;

(b) mixing a binding quantity of said polymer with a taconite concentrate;

(c) pelletizing in a balling apparatus the mixture of step (b) to form green pellets; and (d) indurating said green pellets with heat.

48. The process of claim 47 wherein said polymer contains repeating units selected from the group consisting of units of the formula:

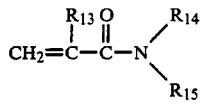

wherein $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation; units of the formula:

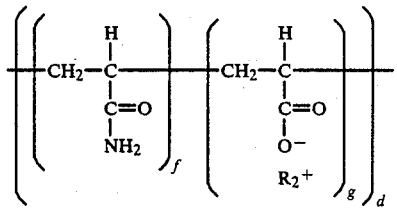

wherein $R_2+$ is an alkali metal ion, f and g are from 5 to about 90 percent, f+g=100, and d s from about 1,000 to 500,000.

49. The process of claim 47 wherein an inorganic salt is also mixed with the concentrate, said inorganic salt being an alkali metal or an alkaline earth metal salt of carbonates, halides, or phosphates, or a combination thereof.

50. The process of claim 49 wherein said inorganic salt is applied to said taconite concentrate in a concentration between about 0.001 to about 0.5 percent by weight and wherein said polymer is applied to said taconite concentrate at an active polymer concentration between about 0.001 to about 0.3 percent by weight.

51. A product of the process of claim 47.

52. The process of claim 12 wherein said inorganic salt is a mixture of a water soluble inorganic salt and at least one member selected from the group consisting of dolomite, maqnesium carbonate, and calcium carbonate.

53. The process of claim 12 wherein said inorganic salt is a mixture of $Na_2CO_3$, used at less than 1.2 lb/tonne of added $Na_2CO_3$, plus at least one member selected from the group consisting of dolomite, magnesium carbonate, and calcium carbonate.

54. The process of claim 52 wherein the water soluble inorganic salt is used in making a flux pellet.

55. The process of claim 54 wherein the water soluble inorganic salt is $Na_2CO_3$.

56. The process of claim 38 wherein said inorganic salt is a mixture of a water soluble inorganic salt and at least one member selected from the group consisting of dolomite, magnesium carbonate, and calcium carbonate.

57. The process of claim 38 wherein said inorganic salt is a mixture of $Na_2CO_3$, used at less than 1.2 lb/tonne of added $Na_2CO_3$, plus at least one member selected from the group consisting of dolomite, magnesium carbonate, and calcium carbonate.

58. The process of claim 56 wherein the water soluble inorganic salt is used in making a flux pellet.

59. The process of claim 58 wherein the water soluble inorganic salt is $Na_2CO_3$.

60. The process of claim 23 including the additonal steps of selecting an inorganic material that tends to reduce the acidity of taconite concentrate and adding that material to the taconite concentrate in an amount sufficient to result in a flux pellet.

61. The process of claim 60 wherein sodium carbonate is commingled with said inorganic material selected to create the flux pellet.

62. The process of claim 47 including the additonal steps of selecting an inorganic material that tends to reduce the acidity of taconite concentrate and adding that material to the taconite concentrate in an amount sufficient to result in a flux pellet.

63. The process of claim 62 wherein sodium carbonate is commingled with said inorganic material selected to create the flux pellet.

* * * * *